US007569005B2

(12) United States Patent
Geeting

(10) Patent No.: US 7,569,005 B2
(45) Date of Patent: Aug. 4, 2009

(54) STANDING POSITION EXERCISE DEVICE

(76) Inventor: Eliot J. Geeting, 76 Terra Vista, Dana Point, CA (US) 92629

( * ) Notice: Subject to any disclaimer, the term of this patent is extended or adjusted under 35 U.S.C. 154(b) by 560 days.

(21) Appl. No.: 11/161,601

(22) Filed: Aug. 9, 2005

(65) Prior Publication Data

US 2007/0037679 A1 Feb. 15, 2007

Related U.S. Application Data

(60) Provisional application No. 60/604,819, filed on Aug. 25, 2004.

(51) Int. Cl.
*A63B 21/02* (2006.01)
*A63B 21/068* (2006.01)
*A63B 69/06* (2006.01)

(52) U.S. Cl. ..... 482/121; 482/95; 482/72

(58) Field of Classification Search ..... 482/95–96, 482/121–126, 140, 72
See application file for complete search history.

(56) References Cited

U.S. PATENT DOCUMENTS

| | | | | |
|---|---|---|---|---|
| 4,603,858 | A | 8/1986 | Reehil | |
| 5,616,109 | A * | 4/1997 | Szu-Ming | 482/123 |
| 6,022,303 | A | 2/2000 | Abdo | |
| 6,302,832 | B1 * | 10/2001 | Stearns | 482/96 |
| 6,422,980 | B1 | 7/2002 | Simonson | |
| 6,440,045 | B1 * | 8/2002 | Gaston | 482/140 |
| 7,108,642 | B1 * | 9/2006 | Stearns | 482/140 |
| 2004/0209752 | A1 * | 10/2004 | Thonn, Jr. | 482/140 |

* cited by examiner

*Primary Examiner*—Fenn C Mathew
(74) *Attorney, Agent, or Firm*—Kelly, Lowry & Kelley; Eric Karich

(57) ABSTRACT

A standing exercise device foldable between operative and storage positions includes a base on which a non-sitting user at least partially stands during a variety of pushing or pulling exercises. A lever is pivotally connected to the base and a mechanism providing adjustable resistance for pushing or pulling exercises connects the base and lever. A handle bar assembly is pivotally connected to and extends upwardly from the lever.

1 Claim, 8 Drawing Sheets

STANDING POSITION EXERCISE DEVICE

BACKGROUND OF THE INVENTION

The present invention relates generally to exercise devices. More particularly, the present invention relates to a standing position exercise device.

Many devices have been created to assist with physical exercise. Some of these devices assist a user in performing exercises that target the abdominal region while others assist the user in performing exercises that target the back region. A few devices are intended to target both the abdominal and the back muscles while some devices are designed to provide a buttocks and quadriceps workout. Other devices have been made with nothing more than a cardiovascular benefit in mind.

Exercise devices have been developed to assist users with performing different exercises to strengthen the core body and, more particularly, the abdominal muscles. Some devices assist with performing a traditional sit-up or crunch while lying on the floor while others work from a seated position. Sit-ups and crunches have long been known as the time tested best way to develop the abdominal muscles. Devices that are used while the user is laying on the floor are generally designed to assist with supporting the user's neck, lifting the user's head and are shaped to allow the user's arms to rest in a forward position to create an assisted sit up or crunch whereby the user's arms assist in lifting their head without the need for placing their hands behind their head or neck. This assistance can be helpful for people that are overweight as it makes a traditional sit up or crunch easier to perform. However it is still hard on the tail bone (often requiring a padded surface to relieve the accompanying discomfort or pain) and although changing the position of the user's hands from behind their neck or head to in front and providing a support for the user's neck and head makes a sit up or crunch easier to perform, it can still be difficult or impossible for some out of shape, overweight people to do even with the assistance of the device. Another limitation is that such devices lack the ability to adjust resistance as the devices simply give a little extra help in lifting. Although the assistance can, in some cases, be adjusted depending on where the user's hands are placed on the device, it makes little significant difference. For the user that is in good shape, the support of the neck and head are helpful. However, the added assistance in actually performing the sit up or crunch makes the movement too easy to perform, which defeats the purpose of the exercise.

There are many devices that are used while a user is in a seated position and these devices work in several different ways with different methods of creating resistance. However, these devices have a few significant limitations. For example, range of motion can be a problem if the user is using a device with a seat that puts the user in an upright position or if the user is using a device that requires the user to sit in a chair. In either case, the user's torso is already at 90 degrees to the user's thighs and many overweight people with large midsections simply do not have room to move in the direction of the crunch without having their midsection interfere with their thighs. The user is also in a seated, relaxed, resting position which is not a position that is conducive to burning calories, getting in shape and exercising. Rather, such a position is better suited to eating or watching television. A number of these devices also lack sufficient padding in the seat which makes them uncomfortable to use, and if the devices are designed to be used while the user is sitting on their own chair, it is difficult for the user to get proper support as a result of the drastic differences in pad, support and angle between various seats, chairs, couches, etc.

Some seated devices are designed with a vertical spring for resistance. For example, U.S. Pat. No. 6,022,303 discloses a device that allows a user to move in all directions. However, the device does not offer a resistance adjustment and that puts a fundamental limitation on the advantage of moving in all directions as a result of different muscle groups having different capabilities. If the device resistance is made to be easy enough for a forward movement, it will be too difficult for a sideways movement. Another limitation is a result of the means for resistance itself; to overcome the spring resistance, a bouncing momentum action can be used by moving in one direction and then using the momentum from the spring to whip the body back in the opposite direction which will help to overcome the resistance in the opposite direction. However, this can put undue strain on the user's neck as a result of this whipping back and forth and from side to side. Another attempt to recreate a sit up or crunch movement is a device, disclosed in U.S. Pat. No. 4,603,858, used while standing or sitting in a chair in order to utilize a means of resistance that rests on the upper torso and bridges across to the thighs. However, there are two fundamental problems with this. The first problem is that the range of motion is limited as a result of the device itself being between the upper torso and the thighs, and the second problems is that the resting position of the lower portion of the device on the thighs results in pressure and digging into the thighs if enough resistance is present to achieve any results from the crunch movement. This creates a strain and pain in the thighs that becomes apparent before any significant abdominal results are achieved.

In both the seated or reclined seated position abdominal category of devices and the general overall body exercise category of devices, there are several professional gym quality devices that can be effective. However they are too large and expensive for the average home user, and these devices also have additional limitations. Most of these devices offer several adjustments to properly position the pivot points of the device to the pivot points of the user's body. However, often one device will not adjust properly for a particular individual. For example, the device might adjust well for a thin person but not for a heavy person, or the device might adjust correctly for a short person but not for a tall person. In another example, the device might adjust comfortably for a woman's body but not for a man's body, or the device might adjust properly for someone with a long torso with short legs, but not for a person with a short torso and long legs, etc. These devices also have multiple types of complicated and expensive resistance systems including pneumatic, hydraulic, electronic, and cable or band devices with weight stacks, all offering variable resistance, and all having additional limitations in addition to the aforementioned limitations. For example, pneumatic resistance systems require air lines, cylinders and a separate compressed air source to adjust their resistance, in addition to the large mechanical apparatus. In another example, the hydraulic systems are most often air-over-oil systems that still require air lines, cylinders, and a separate compressed air source in addition to the large mechanical apparatus and oil. Even a straight hydraulic system requires electricity and a hydraulic pump system as well. The electronically controlled devices require a combination of motors, circuit, and mechanical resistance systems that are controlled by the electronic system (in addition to the massive base unit needed to house all of the control components as well as a place for the users body and adjustment means to allow for adjustment of the device for different body types and sizes). Weight stack systems operated by pulleys and cables or bands are very heavy, expensive and have multiple moving parts, pinch points and are in constant need of lubrication to keep them moving smoothly. Most of these professional quality gym devices do produce smooth and consistent resistance, are effective at achieving results with less repetitions, and do so in a more efficient manner as a result of their adjustable resistance and their full range of motion (when and if a user finds a machine that fits their body type and size).

Many devices have been developed to assist users with performing exercises to strengthen the buttocks and quadricep muscles. However, these devices are often used from a seated position and only offer a leg press movement or a squat movement and do not offer a means to give the core body a balanced workout. Another alternative is for the user to utilize free weights and a rack. However, this can be difficult or dangerous for the inexperienced user and the user needs a second person to "spot" them for a safe workout. Although a back extension can be performed with a free weight bar, the user can not perform abdominal exercises with a weight bar to work their entire core body.

Accordingly, as can be observed from the description of the above mentioned exercise devices, there is a need to overcome the limitations of these devices in order to create a better means for accomplishing the time tested and proven sit up or crunch movement and core body development movements. There is a further need for an abdominal and core body exercise device that does not cause undue stress or strain upon the user's body, thereby hindering the user's movement. There is an additional need for a device that would fit a wide range of body types, sizes, and fitness levels. There is a need for a device that would allow for a full range of motion regardless of the users' body types, sizes and fitness levels. There is also a need for a device that would allow for a reasonable range of adjustment to the level of resistance. There is a further need for a device where the resistance would be easy to change. There is a need for a device that is not overly complex or expensive. There is an additional need for a device that is low maintenance, light weight, compact and collapsible for storage and shipping, and is easy to set up, easy to adjust for body type and size, easy to understand the use of the device, and would also offer cardiovascular benefits. There is a need for a device that allows the user to perform a sit up or crunch movement, a back extension, squat and a lateral side bend for the oblique muscles without getting on the floor, or sitting down and in a way that is easy for a person that is out of shape, but is difficult enough for a person that is in shape as a result of a sufficient means for variable resistance. There is also a need for a device that allows for additional exercises to add variety to the workout and to allow the user to engage different muscles such as the chest, upper back, shoulder, arms etc. without adjusting the device or changing body position as well as achieving a cardiovascular benefit at the same time. There is a further need for a device that allows a user in a standing position to do an abdominal crunch, with their torso weight pushing downward (the heavier the person is, it does not make the movement more difficult to perform which is the case with a traditional sit up or crunch). There is an additional need for a device that allows a user in a standing position to work in conjunction with the pivot points of the device. There is a need for a device that provides a user with height adjustment that allows individuals of all body types and sizes to comfortably use the device.

SUMMARY OF THE INVENTION

The present invention enables the user to perform core body exercises such as a sit up (or crunch), a lateral side bend, a squat, and a lower back extension with a variable resistance from a standing position, to specifically exercise the upper and lower abdomen, obliques, lower back, buttocks plus the quadriceps with just four simple movements without putting undue strain on the neck, back or tail bone. A device embodying the present invention also allows the user do many other exercises that are not its primary function such as the lunge, biceps curls, triceps extension, row, up right row, press, calf raises, etc. and also allows the user to achieve a cardiovascular workout at the same time.

As can be appreciated, any exercise motion that creates undue stress on the neck, back, tailbone or other parts of the body will negate the benefit of the exercise motion. A variable resistance, standing position exercise device embodying the present invention permits users of all fitness levels to train and strengthen their abdominal muscles in the same manner as a traditional sit up or crunch without having to get down on the floor, pick up their own upper torso weight, hold their feet down on the floor or put undue strain on the neck, back, tailbone or other parts of the body. The user can also train and strengthen their buttocks and quadriceps by performing a standing position squat with variable resistance without the need to put a weight bar behind their neck utilizing this one simple device. The user can also train their abdominal oblique muscles by performing a standing side bend and the lower back muscles by performing a standing back extension allowing for a full core body workout with just 4 simple exercises. The movements are performed in the same manner as the time tested traditional movements utilized to train the core body yet without having to put undue strain on the neck, back, tail bone or other parts of the body and with minimal body position change or machine adjustment between exercises and all from a comfortable standing position.

In an embodiment of the present invention, a standing exercise device, foldable between operative and storage positions, includes a base on which a non-sitting user at least partially stands during a variety of pushing or pulling exercises. A lever is pivotally connected to the base. The device also includes a mechanism for providing adjustable resistance for pushing or pulling exercises and the mechanism connects the base and lever. A handle bar assembly is pivotally connected to and extends upwardly from the lever.

The base of the standing exercise device includes a side section that is foldable between the operative and storage positions.

The adjustable resistance mechanism includes a set of notches in the lever. A selected one of the set of notches provides greater resistance than a first adjacent notch on one side of the selected notch, and lesser resistance than a second adjacent notch on the other side of the selected notch.

The adjustable resistance mechanism includes a first set of notches for pull exercises and a second set of notches for push exercises. Each set of notches provides a distinct range of resistance.

The adjustable resistance mechanism also includes a flexible band that is connected at a first end to the base. A second end of the band (opposite the first end of the band) is connected to the lever. The first end of the flexible band is pivotally connected to a central section of the base. The second end of the flexible band engages a first section of the lever for pull exercises and a distinct second section of the lever for push exercises.

The handle bar assembly includes hand grips and a mechanism for adjusting the vertical position of the hand grips.

The standing exercise device includes a riser having a first end pivotally connected to the base and a second end pivotally connected to the lever. The riser is movable between the operative and storage positions.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

The present invention is directed to an exercise device that enables the user to perform a sit up or crunch movement from a standing position and enables the user to perform a sit up or crunch and a squat movement without putting a strain on their neck, back, tail bone or other parts of their body. The present invention enables the user to perform a sit up or crunch movement, squat, side bend and back extension to exercise the core region of the body regardless of the size, shape or condition of the user's body. The exercise device of the present invention enables the user to adjust the device for their particular body type and sizes with one simple height adjustment and enables a heavy person to more easily perform a crunch as a result of the user being able to push down with their body weight as opposed to the lifting up required in a traditional sit up or crunch.

Figure 1:
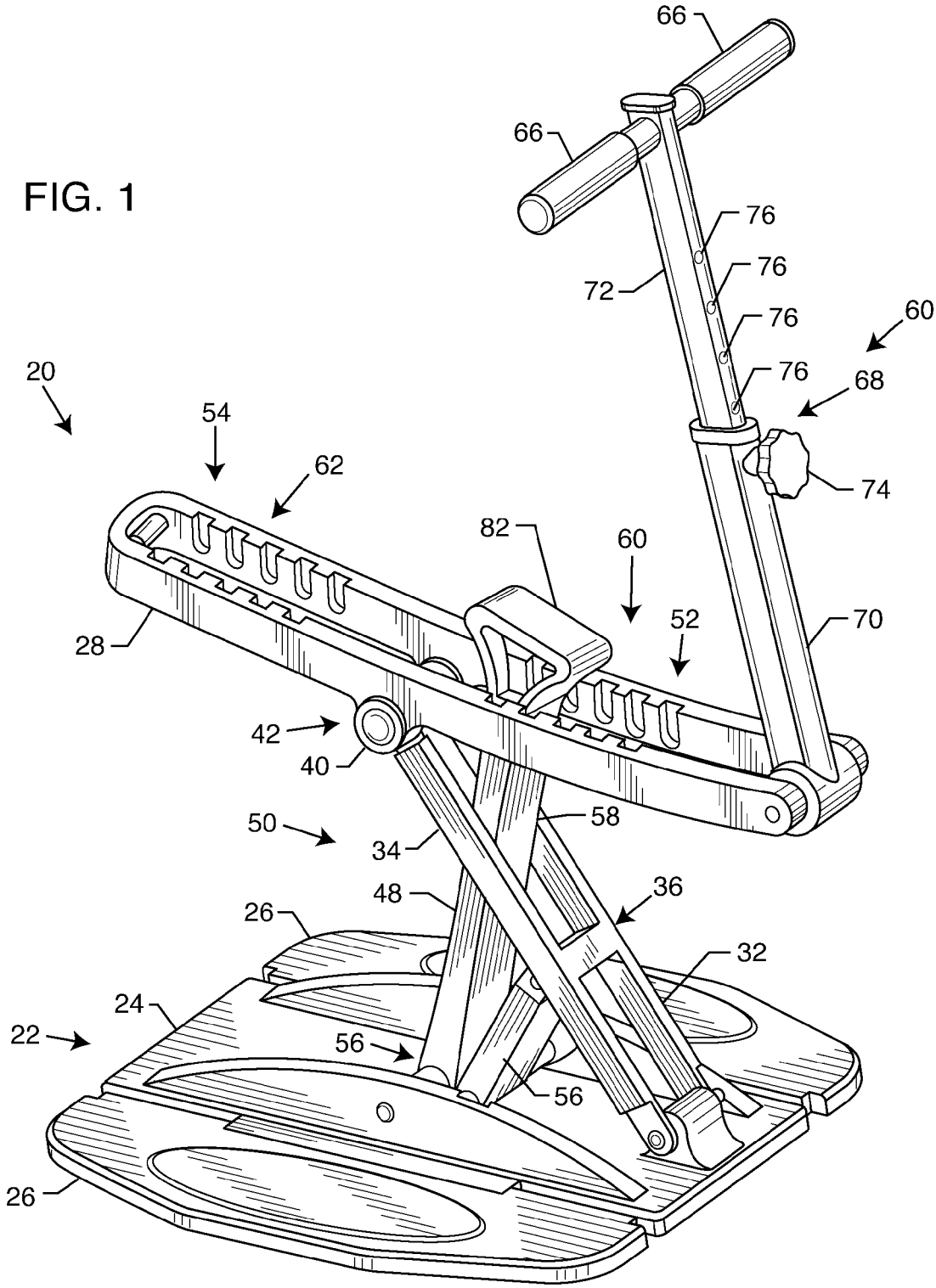
FIG. 1 is a perspective view of a standing exercise device embodying the present invention in an operative position.
Figure 2:
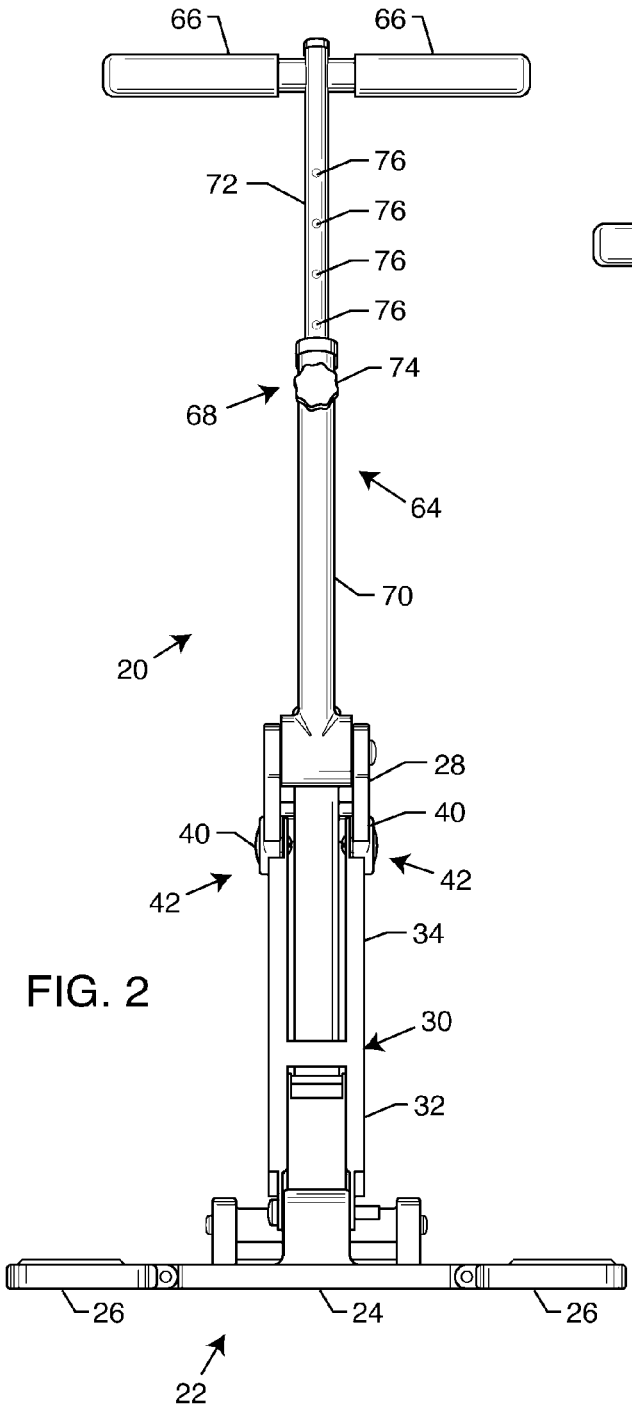
FIG. 2 is a front elevational view of the device of FIG. 1.
Figure 3:
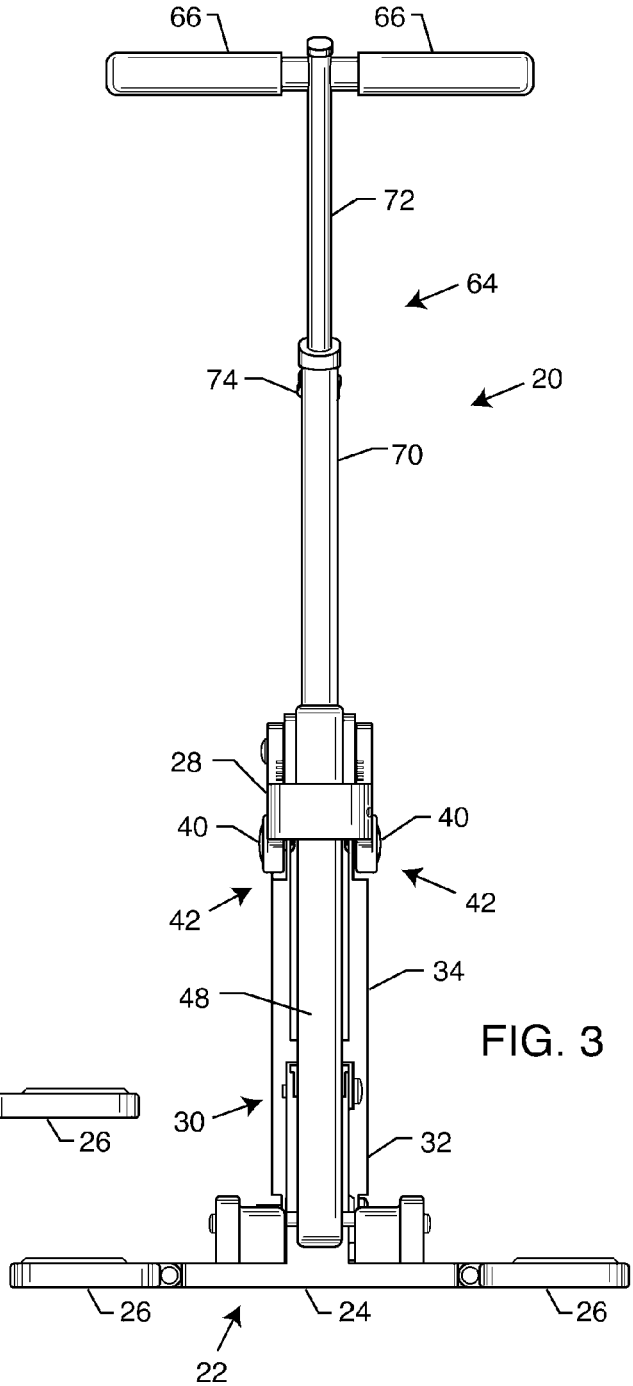
FIG. 3 is a rear elevational view of the device of FIG. 1.
Figure 4:
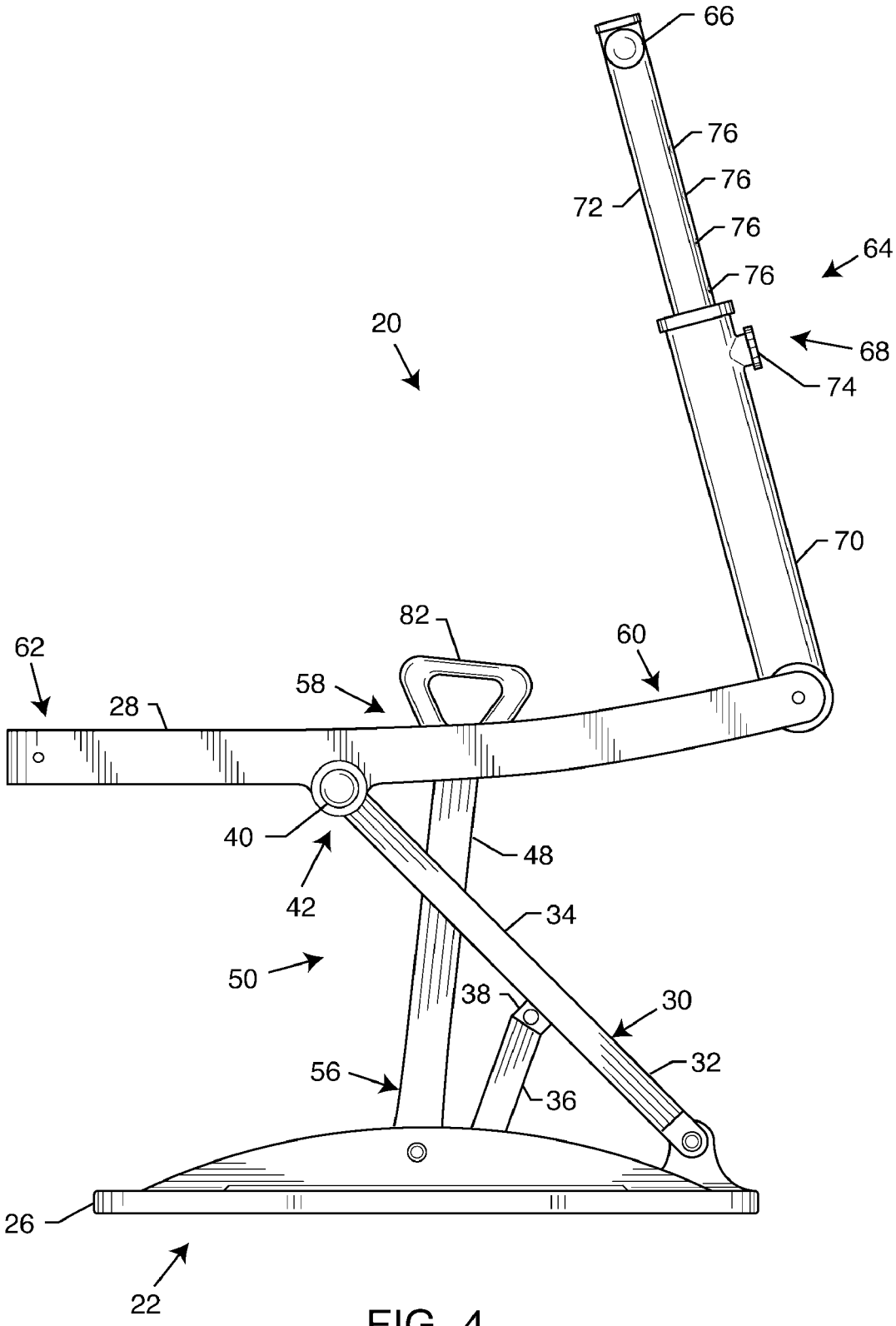
FIG. 4 is a right side elevational view of the device of FIG. 1.
Figure 5:
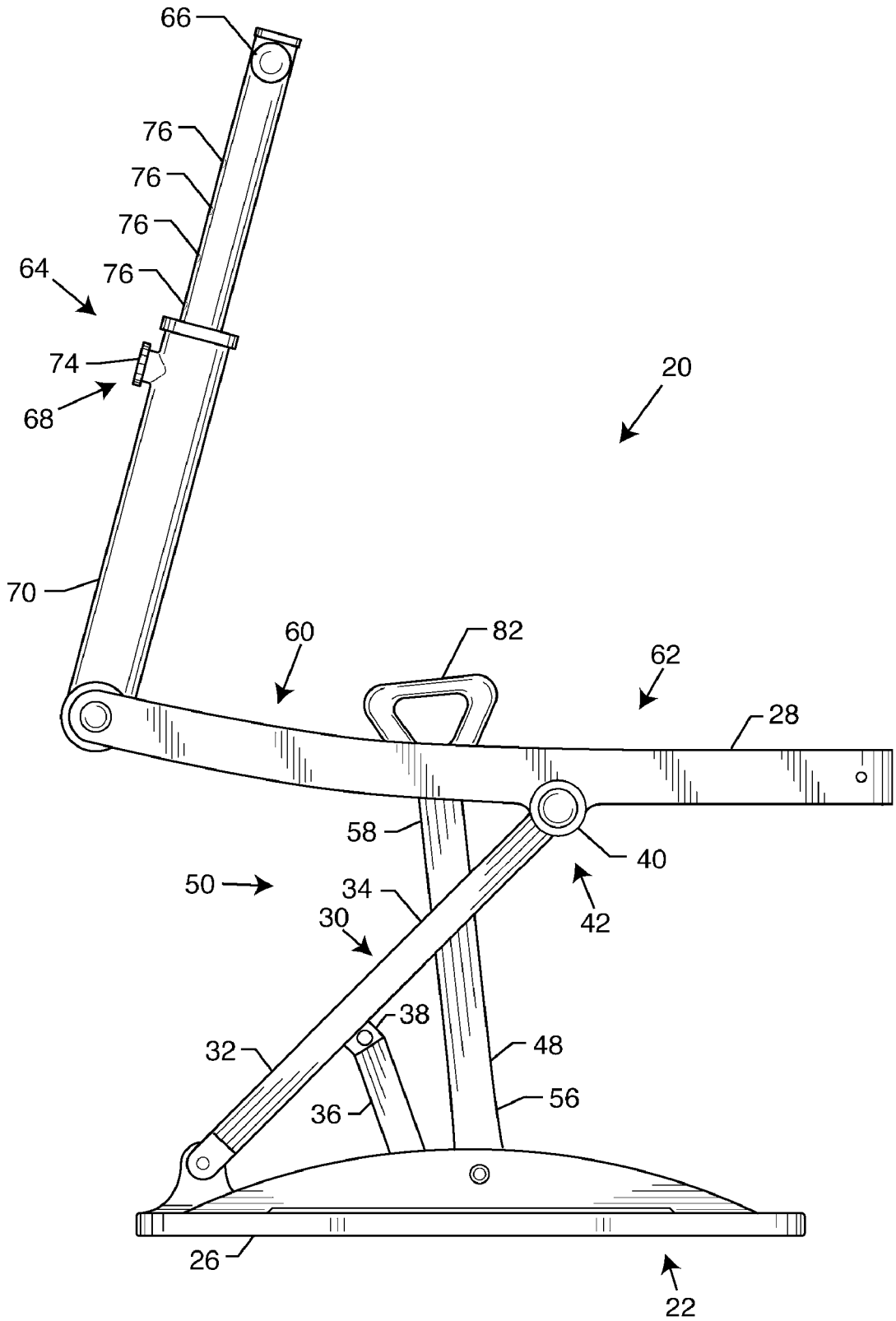
FIG. 5 is a left side elevational view of the device of FIG. 1.
Figure 6:
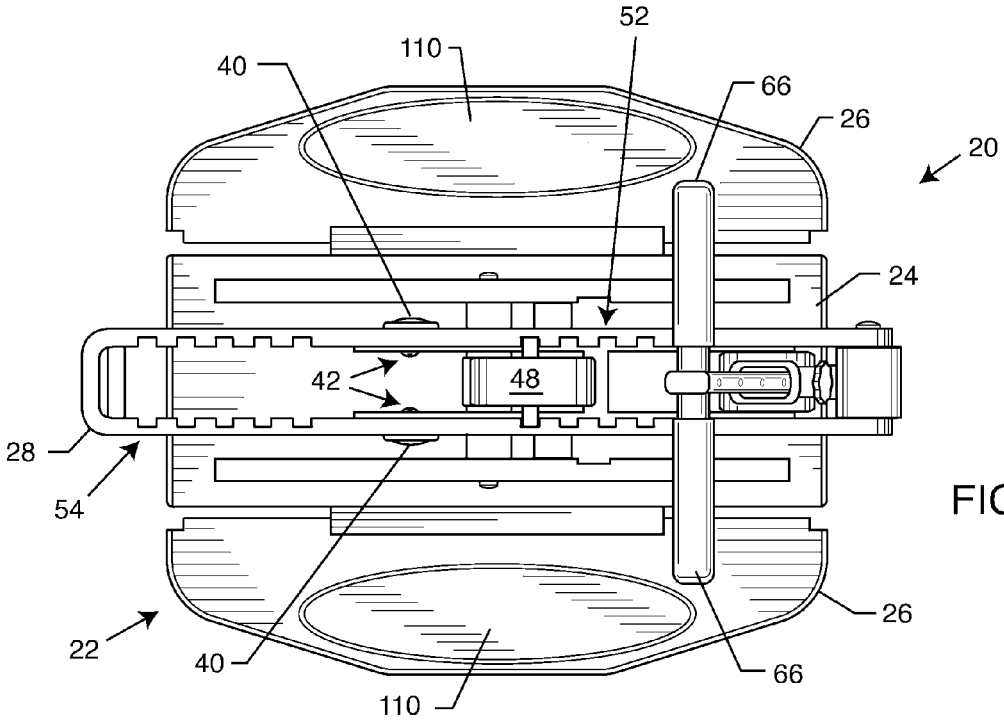
FIG. 6 is a top plan view of the device of FIG. 1.
Figure 7:
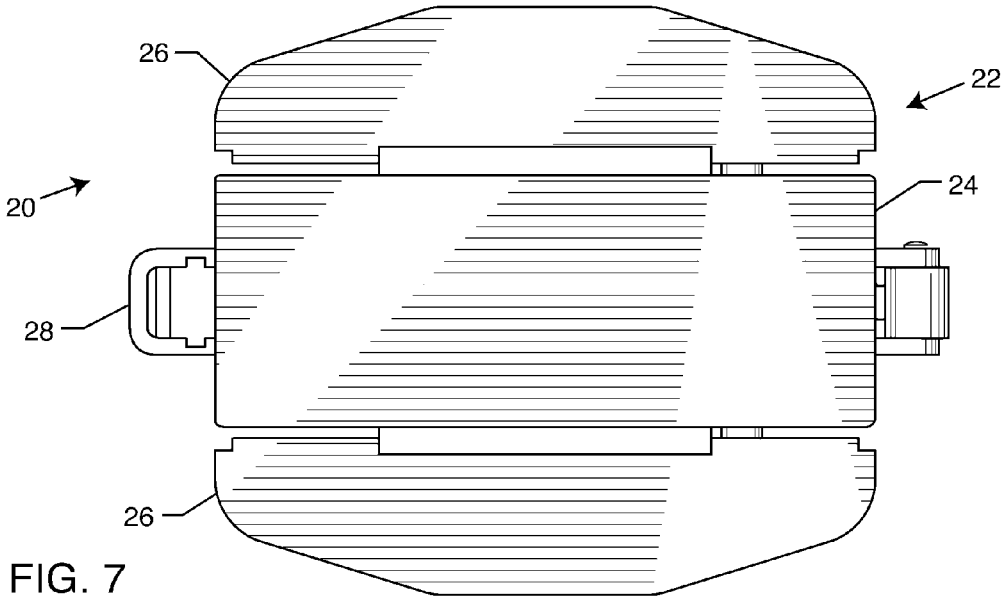
FIG. 7 is a bottom plan view of the device of FIG. 1.
Figure 8:
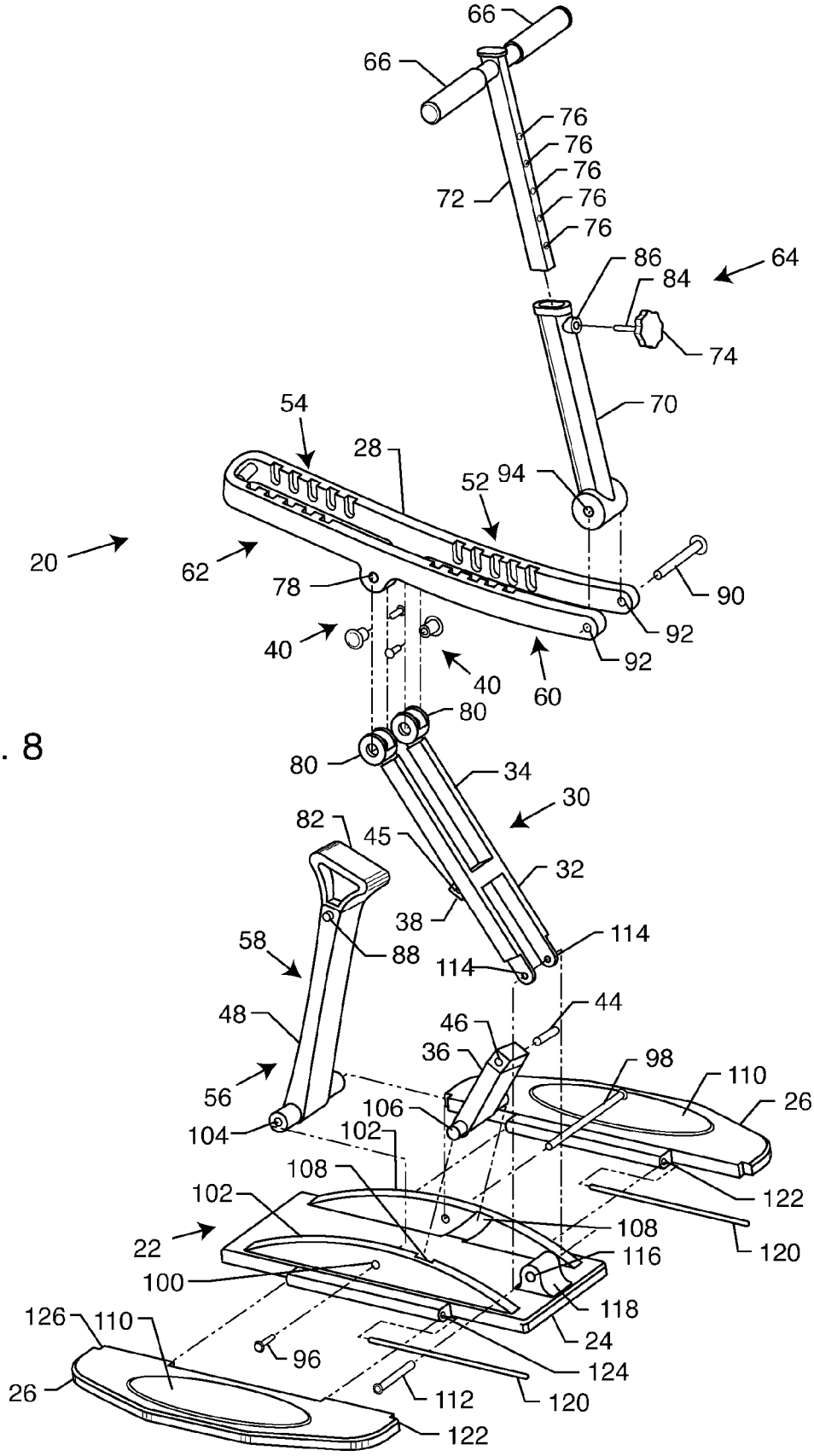
FIG. 8 is an exploded perspective view of the device of FIG. 1.
Figure 9:
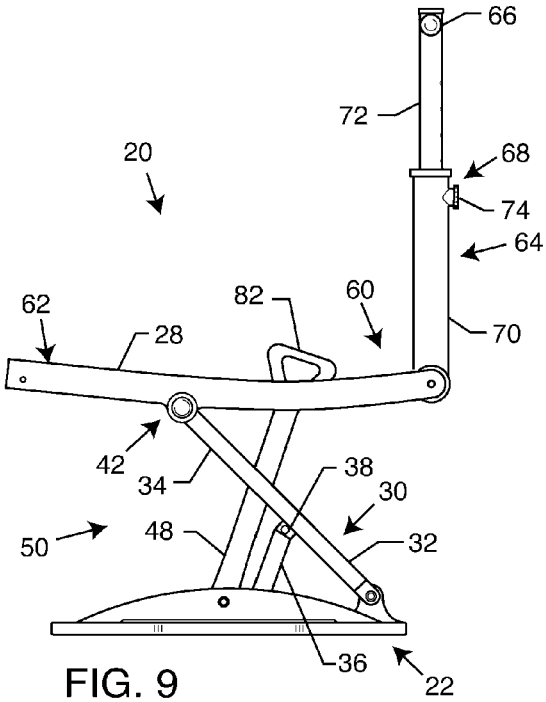
FIG. 9 is a right side elevational view of the device of FIG. 1 configured for pulling exercises.
Figure 11:
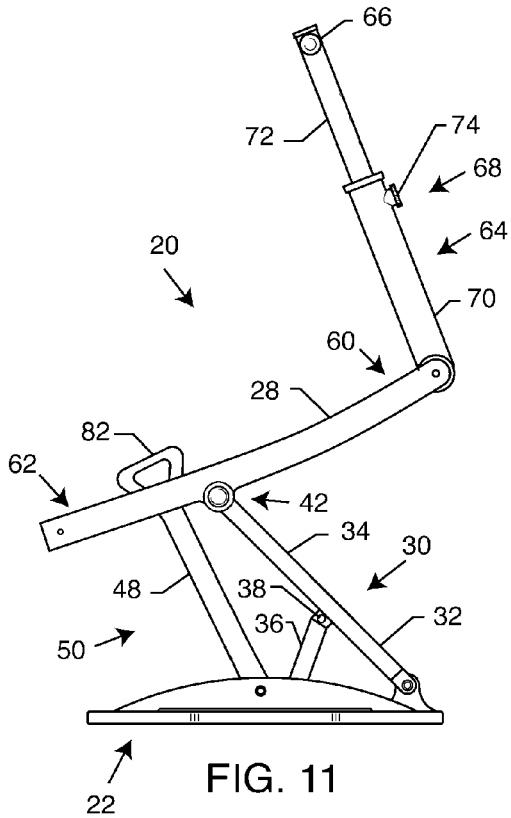
FIG. 11 is a right side elevational view of the device of FIG. 1 configured for pushing exercises.
Figure 10:
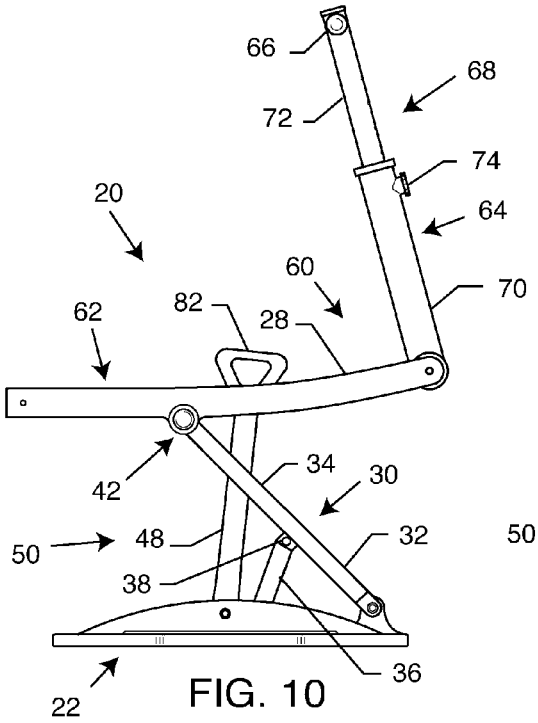
FIG. 10 is a right side elevational view of the device of FIG. 9 illustrating the handle bar assembly and lever of the device having been pulled to a new position from that shown in FIG. 9.
Figure 12:
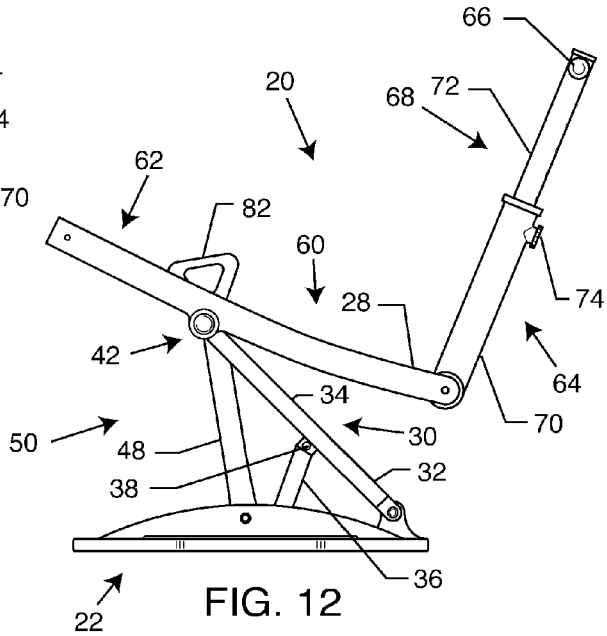
FIG. 12 is a right side elevational view of the device of FIG. 11 illustrating the handle bar assembly and lever of the device having been pushed to a new position from that shown in FIG. 11.
Figure 13:
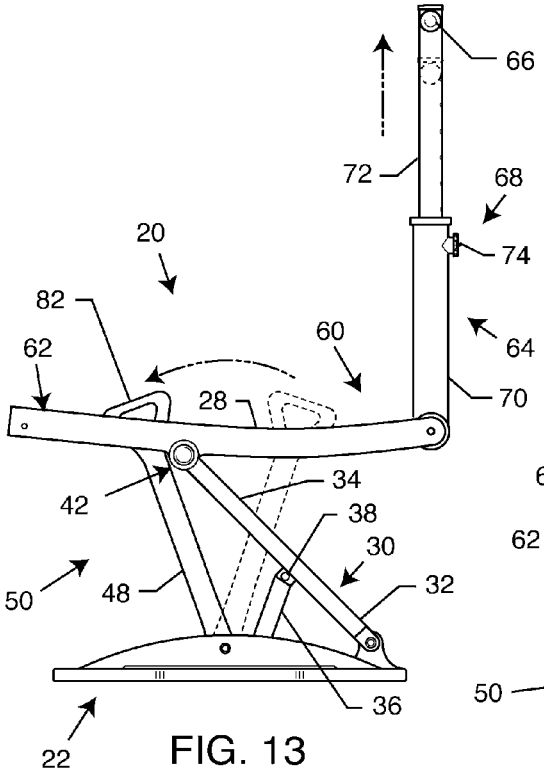
FIGS. 13-16 illustrate the device of FIG. 1 moving from an operative position (FIG. 13) to a storage position (FIG. 16).
Figure 14:
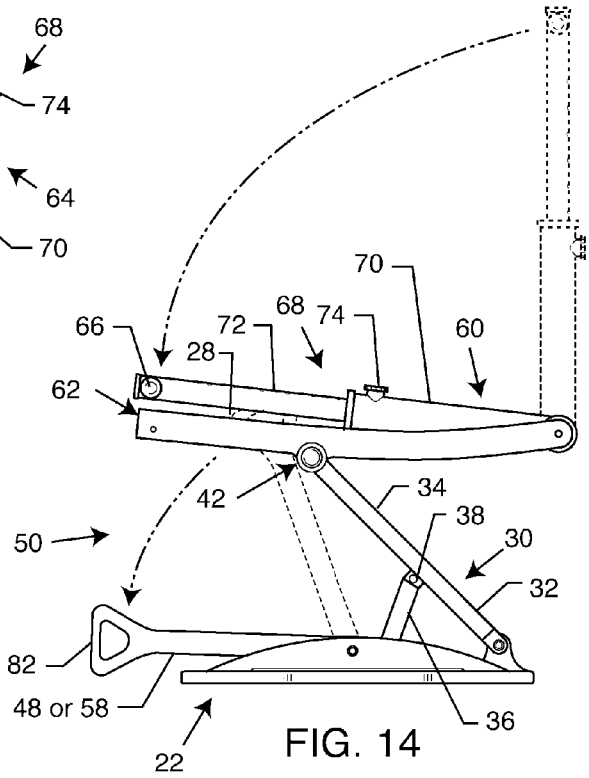
Figure 15:
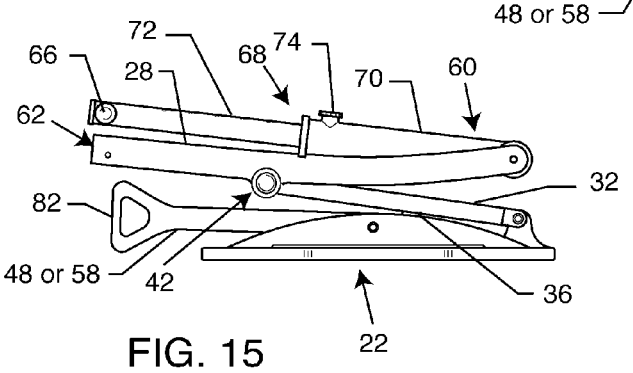
Figure 16:
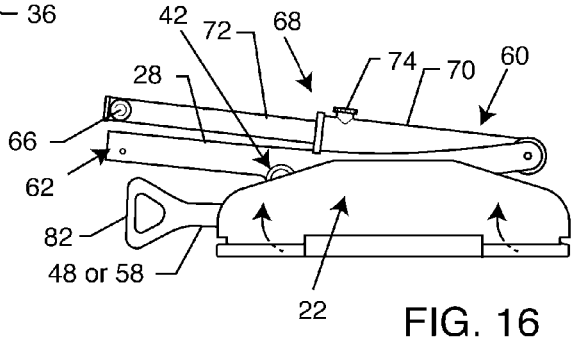

In accordance with one embodiment of the present invention, a standing exercise device 20, as illustrated in FIGS. 1-16, foldable between operative and storage positions, includes a base 22 on which a non-sitting user at least partially stands during a variety of pushing or pulling exercises. The base 22 is a platform that is preferably made of a lightweight, molded plastic or could be made of wood. Alternatively, the base 22 could have high-density foam on top for comfort, and could be made of any sturdy ridged material that can act as a foundation for the device 20, and a place for the user to stand. The base 22 is a full platform in the operative position that includes a center section 24 with swing out, folding side sections 26 on opposite sides of the center section 24 that allow the base 22 to be folded In the storage position; allowing the device 20 to be compacted for storage not only vertically, but horizontally as well. Each folding side section 26 includes a footpad 110 upon which a user's foot can rest during exercise and is connected to the center section 24 via a quick release pin 120 is inserted through a bore 122 of a portion of the side section 26, a bore 124 extending through a portion of the center section 24, and a bore 126 of another portion of the side section 26 in order to allow the side sections 26 to pivotally move between operative and storage positions.

A U-shaped pivot lever 28 is pivotally connected to the base 22 via an H-shaped riser 30 having a first end 32 pivotally connected to the base 22 and a second end 34 pivotally connected to the lever 28. The riser 30 is pivotally movable between the operative and storage positions. In the storage position, the riser 30 is pivoted so that the riser 30 is adjacent to the center section 24 of the base 22. A riser support 36 is pivotally connected to the base 22 and a pair of riser support anchors 38 are connected to the riser 30. The riser support 36 is pivotally movable between the operative and storage positions. The pivot lever 28 is pivotally connected by a pair of fasteners 40 to the upper most portion of the riser 30 at a pair of pivot points 42, allowing the pivot lever 28 to pivot or teeter-totter in an up and down motion on the riser 30 with respect to being parallel to the base 22. The fasteners 40 extend through respective apertures 78, 80 of the lever 28 and riser 30 to pivotally connect the lever 28 and riser 30. Alternatively, the riser 30 could be a fixed upright member attached to the base 22 in an embodiment of the present invention that is not foldable. A quick release pin 44 is inserted through an aperture 45 of one of the riser support anchors 38, a bore 46 on one end of the riser support 36 and the aperture 45 of the other of the riser support anchors 38 in order to hold the riser 30 in an upright, operative position. A quick release pin 112 is inserted through an aperture 114 one side of the end 32 of the riser 30, a bore 116 of a mount 118 located on the center section 24 of the base 22 and the aperture 114 of the side of the end 32 of the riser 30 in order to hold the riser 30 in an upright, operative position and allow the riser 30 to pivotally move between operative and storage positions.

The pivot lever 28 works in conjunction with a resilient member 48 to provide a means 50 for providing adjustable resistance for pushing or pulling exercises. Both the riser 30 and the resilient member 48 connect the base 22 and lever 28. The lever 28 includes a first set of notches 52 for pull exercises (i.e., exercises that pull on the lever 28) and a second set of notches 54 for push exercises (i.e., exercises that push on the lever 28). Each set 52, 54 of notches are located on the interior of the U-shaped lever 28. Each set 52, 54 of notches provides a distinct range of resistance as a selected notch of one of the sets 52, 54 of notches provides greater resistance than a first adjacent notch on one side of the selected notch, and lesser resistance than a second adjacent notch on the other side of the selected notch when the resilient member 48 engages the selected notch. In this manner, resistance can be increased or decreased by engaging the resilient member with various notches of the first set of notches 52 for pull exercises and various notches of the second set of notches 54 for push exercises. The resilient member 48 could be any resilient material including, without limitation, shock cord, bungee cord, surgical tubing or the like. Alternatively, the resilient member 48 could also be a gas shock cylinder or any means of creating a resistance in both the stretching and compressing directing. Preferably, the resilient member 48 is a flexible heavy duty molded rubber band commonly found on fitness devices. The flexible band 48 is pivotally connected at a first end 56 to the center section 24 of the base 22 and a second end 58 of the band 48 (opposite the first end 56 of the band 48) is connected to the lever 28 when the second end 58 of the flexible band 48 engages a first section 60 of the lever 28 that includes the first set of notches 52 for pull exercises or a distinct second section 62 of the lever 28 that includes second set of notches 54 for push exercises. The second end 58 of the band 48 includes a hand grip 82 that allows a user to more easily grasp and pull the band 48 to move the band 48 from one notch of the sets 52, 54 to another notch. Push/pull resistance adjustment is accomplished by the teeter-totter action of the pivot lever 28, pulling against the resilient member 48, and dependant upon which notch of the sets of notches 52, 54 the resilient member 48 is engaging along the length of the pivot lever 28. The second end 58 of the band 48 includes a pair of cylindrical wedges 88 with one wedge 88 located on each side of the band 48. The wedges 88 are sized and shaped to slide within and engage the notches of the sets 52, 54. In order to move the band 48 from one notch to another, the user pulls the band 48 so that the wedges 88 disengage from a pair of notches on opposite sides of the lever 28 and pivots the band 48 to a desired pair of notches of a particular set 52, 54 where the user aligns the wedges 88 with the new notches and then releases the band 48 so that the resiliency of the band 48 allows the wedges 88 to enter and engage the notches of the particular set of notches 52, 54. The resistance of the band 48 does not pull the wedges 88 into the notches by its resistance because the lever 28 simply pivots rendering the resistance a non-issue. The lever 28 is pushed or pulled to shape the wedges 88 into place. Fasteners 96, 98 inserted through an aperture 100 of one of a pair of upwardly extending planar members 102 of the center section 24 of the base 22, a bore 104 on the first end 56 of the resilient member 48 and the aperture 100 of the other of the pair of upwardly extending planar members 102 in order to pivotally connect the resilient member 48 to the base 22. Cylindrical wedges 106 of the riser support 36 engage slots 108 of the planar members 102 that assist the riser support 36 in moving between operative and storage positions.

A handle bar assembly 64 is pivotally connected to and extends upwardly from the lever 28. The assembly includes a pair of hand grips 66 and a means 68 for adjusting the vertical position of the hand grips 66. The position adjusting means 68 includes a lower section 70 pivotally connected to the lever 28 and an upper section 72 that telescopically fits within the lower section 70. The handle grips 66 are grasped by the user to perform exercises and the hand grips 66 are rotatably mounted to the upper section 72 so that the hand grips 66 rotates with respect to the upper section 72 even as the handle bar assembly 64 pivots with respect to the lever 28. A rotatable knob 74 allows the user to adjust the vertical height of the hand grips 66. The knob 74 includes a shank 84 on one end. Rotation of the knob 74 in one direction allows the user to disengage the shank (which extends through an aperture 86 in the lower section 70) from one of a number of apertures 76 aligned along the upper section 72 so that the user can raise or lower the upper section 72 within the lower section 70. When the aperture of the lower section 70 is aligned with a desired aperture 76 of the upper section 72, rotation of the knob 74 in the other direction allows the shank to engage the desired aperture 76. In the alternative, the hand grips 66 are removable or foldable against the lower and/or upper sections 70, 72 in the storage position. A quick release pin 90 is inserted through an aperture 92 on one side of the lever 28, a bore 94 through a lower end of the lower section 70, and the aperture 92 on the other side of the lever 28 in order to pivotally connect the lever 28 and handle bar assembly 64.

In use, the user performs the following actions: (i) the user unfolds the device 20 if it was stored by lifting the pivot lever 28 and connecting the riser support 36 to the center section 24 of the base 22 by inserting the cylindrical wedges 106 into the slots 108, thereby lifting the riser 30 into operative position; (ii) the user sets the level of resistance by moving the resilient member 48 to a desired notch of one of the sets 52, 54 of notches, selecting push or pull resistance by selecting the appropriate set 52, 54 of notches, and engaging the resilient member 48 with the desired notch of the lever 28; (iii) the user stands on the base 22 facing the front of the device 20 and grasps the hand grips 66 of the handle bar assembly 64 to check for height adjustment and then sets the hand grips 66 at the appropriate height level for the users height by adjusting the height of the hand grips 66 using the adjustment means 68; (iv) the user then performs the desired exercise; (v) the user can perform exercises one after another without resting in between as a result of the quick adjustment ability of the device 20 which allows the user to achieve a cardiovascular benefit in addition to the strength training, toning, weight loss and overall core body slimming and development that can be achieved by using the device 20; and (vi) the user can then release the riser support 36 from the center section 24 of the base 22 by removing the cylindrical wedges 106 from the slots 108, in order to allow the device 20 to pivotally collapse into the storage position when the user is finished with exercise (folding the side sections 26 of the base 22 upwards into the storage position). The pivotal connections between various components, such as the riser 30, lever 28, and handle bar assembly 64 allows the device to move between the operative and storage positions.

The device 20 can be used on virtually any surface that a user could comfortably stand on such as tile, carpet, concrete, wood, grass, dirt, etc. The device 20 generates resistance and provides cardiovascular benefit without the need for complex and/or costly mechanical components such as cables, pulleys, gears, chains, sprockets, motors or electricity. The device 20 can generate assistance for an out-of-shape user by using the push resistance in a pull exercise, or the pull resistance for a push exercise, thereby creating assistance, and resistance device.

Although an embodiment of the present invention has been described in detail for purposes of illustration, various modifications may be made without departing from the scope and spirit of the invention.

What is claimed is:

1. A standing exercise device for use by a user, the standing exercise device comprising:

a base on which the user at least partially stands during a variety of pushing and/or pulling exercises;

a riser having a first end connected to the base, and a second end opposite the first end that extends upwardly from the base;

a lever pivotally supported by the riser such that the lever can teeter-totter in an up and down motion on the riser with respect to being parallel to the base;

a first set of notches and a second set of notches on the lever, the lever being pivotally connected to the second end of the riser such that the first set of notches are on one side of the riser and the second set of notches are on the other side of the riser, opposite the first set of notches;

a resilient member having a first end and a second end, the first end being attached to the base, and the second end being adapted to engage one of the first or second set of notches; and a handle bar assembly pivotally mounted on only the lever, not engaging the base, and extending upwardly from the lever, the handle bar assembly having hand grips and a means for adjusting the vertical position of the hand grips, the means for adjusting including a lower section pivotally connected to the lever and an upper section that telescopically fits within the lower section, the hand grips being mounted on the upper section.

* * * * *